US005135201A

United States Patent [19]

Engel et al.

[11] Patent Number: 5,135,201

[45] Date of Patent: Aug. 4, 1992

[54] LIFT CAP FOR A JACK

[76] Inventors: Darryl L. Engel, 0436 CR62, LaOtto, Ind. 46763; John R. Scoville, 4625 CR79, Butler, Ind. 45721

[21] Appl. No.: 723,564

[22] Filed: Jul. 1, 1991

[51] Int. Cl.[5] ..... B66F 3/22

[52] U.S. Cl. ..... 254/126

[58] Field of Search ..... 254/126, 122, 124, 133, 254/DIG. 4

[56] References Cited

U.S. PATENT DOCUMENTS

| | | | |
|---|---|---|---|
| 1,701,314 | 2/1929 | Shook | 254/126 |
| 4,194,725 | 3/1980 | Erschens | 254/126 |
| 4,848,733 | 7/1989 | Yamauchi et al. | 254/126 |

FOREIGN PATENT DOCUMENTS

| | | | |
|---|---|---|---|
| 2936002 | 3/1981 | Fed. Rep. of Germany | 254/126 |
| 3033956 | 6/1982 | Fed. Rep. of Germany | 254/126 |
| 2145392 | 3/1985 | United Kingdom | 254/126 |

*Primary Examiner*—Robert C. Watson

[57] ABSTRACT

An improved lift cap for a jack which comprises a two-piece lift cap that fit together with tab and slot arrangements and which allow the overall mass of the jack to be substantially reduced by allowing the width of the base and channels to be reduced. The improved lift cap has a raised portion which serves as a stop to align the jack and which also provides additional support to lift a vehicle which is being lifted by the jack.

4 Claims, 1 Drawing Sheet

LIFT CAP FOR A JACK

BACKGROUND OF THE INVENTION

1. Field of the invention

This invention relates in general to jacks and in particular to an improved lift cap for a jack.

2. Description of Related Art

Conventional vehicle jacks such as scissors jacks have a lift cap for engaging the vehicle, but the stability of the jack has been achieved by using a wide base and wide channels. Jacks are sometimes utilized to lift on the rocker flange of the vehicle which is not strong enough when the vehicle is fully loaded such that the flange is bent and distorted as lifting occurs.

SUMMARY OF THE INVENTION

The present invention comprises an improved lift cap for a jack which is constructed in two pieces which are connected together using tabs and slots rather than welding or rivets and such that the load bearing member of the vehicle holds the tabs in place during lifting so they do not straighten out.

The jack of the present invention has a raised portion of the lift cap which acts as a stop that provides a positive stop for placing the jack under the vehicle and also provides additional support to lift the car. The two pieces of the lift cap interlock so as to prevent their junction point from catching on the rocker panel flange of the vehicle as the jack is moved into position.

It is an object of the present invention to provide a two piece lift cap which provides additional lifting surface for the lift cap and also allows the jack to be constructed with substantially less material than jacks of the prior art so as to provide a strong and stable jack lift cap that can be easily assembled.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
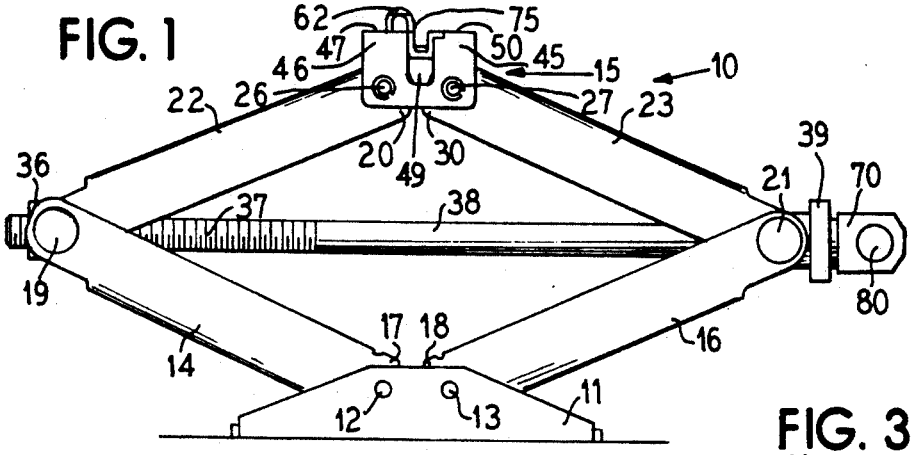
FIG. 1 is a side plan view illustrating the improved back lift cap in position on a jack.
Figure 3:
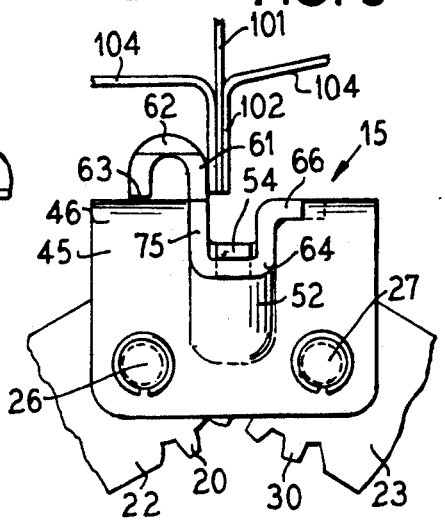
FIG. 3 is a side plan view at 90° to FIG. 2 of the lift cap.
Figure 5:
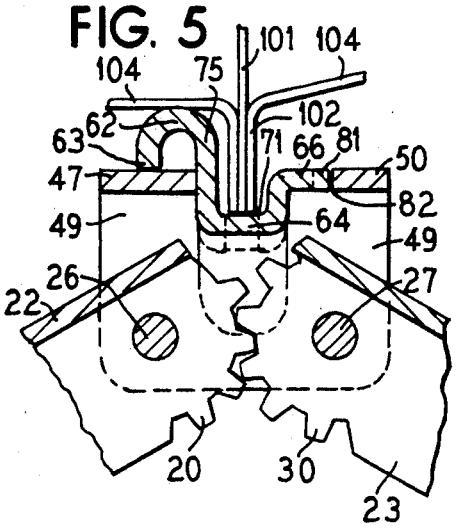
FIG. 5 is a sectional view taken on line V—V from FIG. 4.

FIG. 1 illustrates a scissors type jack generally of the type illustrated in U.S. Pat. No. 4,986,802 assigned to the assignee of the present invention. The jack 10 has a base 11 through which a pair of pivot pins 12 and 13 extend that rotatably support a first pair of links 14 and 16 and a second pair of links, not shown. The opposite ends of the links 14 and 16 and the two links not shown are connected by pivot pins 19 and 21 to upper links 22 and 23. The ends of the links 14 and 16 and the other links not shown are formed with gears as, for example, gear teeth 17 and 18 which mesh together in a conventional manner. The upper links 22 and 23 are formed with gear teeth 20 and 30 which mesh together as shown in FIG. 5. The novel lift cap 15 of the invention is connected to the links 22 and 23 by pivot pins 26 and 27 as illustrated in FIGS. 1, 3 and 5.

A threaded collar 36 on pin 19 receives the threaded portion 37 of a shaft 38 which has an opposite end which passes through a collar 39 and has a driving portion 70 formed with openings 80 through which a shaft can be extended to rotate the shaft 38 to raise and lower the jack 10.

The novel lift cap 15 is formed of two pieces which are connected together with tabs and slots so as to eliminate any fasteners or costly assembly operation. The novel lift cap has a raised portion which acts as a stop as the jack is positioned under the vehicle and the raised portion also provides additional support to engage the vehicle to distribute the weight in an advantageous manner as lifting occurs. The two pieces of the improved lift cap interlock so that there is not a straight seam between the pieces which could catch as the jack is placed in position.

Figure 2:
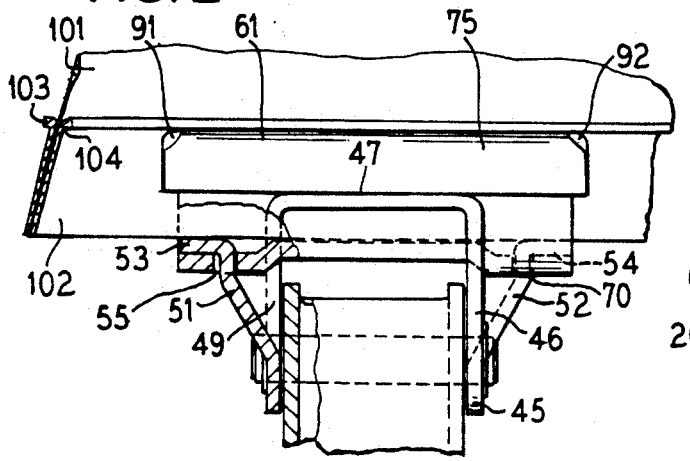
FIG. 2 is a side plan view of the jack lift cap.
Figure 4:
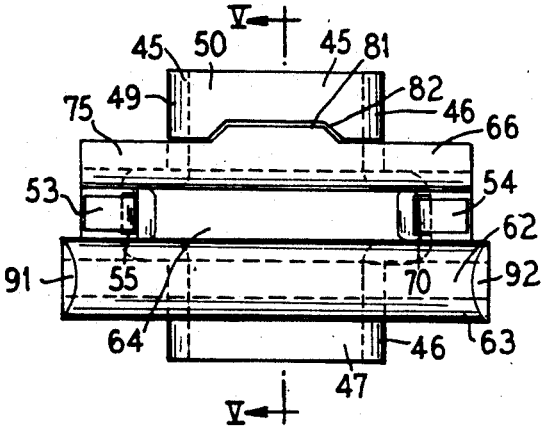
FIG. 4 is a top plan view of the jack lift cap.

The first piece of the jack comprises a generally U-shaped member 45 which has downwardly extending sides 46 and 49 which are joined by two top members 47 and 50 that are separated by a longitudinal gap therebetween. As best shown in FIGS. 2, 3 and 4, the end 49 is formed with a tab 51 which has an end 53 and the end 46 is formed with a tab 52 which has an end 54. The second piece 75 of the lift cap is formed with an upper curved raised portion 62 which has an end 63 and a downwardly extending portion 61 which is received in the groove of member 45. The member 75 has a bottom portion 64 which fits in the groove of the member 45 and has an upper extending portion 66 as shown in FIGS. 2, 4 and 5. The member 75 is formed with openings 55 and 70 through which the tabs 53 and 54 of member 45 extend and the tabs 53 and 54 are bent in opposite directions as shown in FIG. 4 and FIG. 2 so as to lock the pieces together. The top edge 66 is formed in member 45 as shown in FIG. 4 so that there will be no straight seam to of member 75 is formed with an extending tab 81 which mates with a slot 82 catch on a flange of the vehicle as the jack is moved into position.

The ends 91 and 92 of top 62 are beveled as shown in FIGS. 2 and 4 to prevent them from catching on surfaces of the vehicle as the jack is positioned.

In use, the jack 10 is placed in position by moving the jack until the raised portion 62 of the lift cap 15 engages the flange 102 of the vehicle as shown in FIGS. 2, 3 and 5. The upper curve portion 62 engages the plate 104 of the flange 102 as the vehicle is lifted. The bottom of the flange 102 engage the upper surface 64 of member 75 and the tabs 53 and 54 of the member 45 as shown in FIGS. 2, 4 and 5 as the vehicle is lifted.

The novel lift cap of the present invention allows the stability of the jack to be increased and also allows a smaller amount of material to be used in the jack and in a particular model allows the mass of the jack to be reduced by 20% or more. Since the two-piece assembly comprising the members 45 and 75 are connected together with tabs and slots, the prior art method of welding or riveting pieces together is eliminated thus reducing the cost of manufacturing a lift cap according to the invention.

The novel raised portion 63 of the lift cap acts as a stop as well as a lifting surface so as to distribute the weight over a larger area and thus increase the efficiency of the jack and the lift cap. This also makes it unnecessary to reinforce the rocker flange since the load is distributed over a larger area. The use of founded or chamfered corners reduces the change of damaging the rocker panel.

Although the invention has been described with respect to preferred embodiments, it is not to be so limited as changes and modifications can be made which are within the full intended scope of the invention as defined by the appended claims.

We claim as our invention:

1. An improved lift cap for a jack which is mounted on the upper portion of the jack so as to engage a vehicle which has a flange comprising:

a first member which is generally U-shaped and has first and second downwardly extending sides which have their lower portions attached to said jack and has a top portion which connects said first and second downwardly extending sides and a slot formed in said top portion;

a second member formed with a downwardly extending U-shaped portion receivable in said slot of said first member and said second member formed with a raised portion which has an end that engages said top of said first member such that when lifting a vehicle with a flange, the flange is received in said slot against said downwardly extending portion of said second member and said raised portion of said second member engages said vehicle adjacent said flange, and wherein first and second tabs extend from said first and second downwardly extending sides of said first member and the ends of said first and second tabs received in first and second openings formed in said downwardly extending U-shaped portion of said second member so as to lock said first and second members together.

2. An improved lift cap for a jack according to claim 1 wherein said raised portion of said second member is generally semi-circular shaped in cross-section.

3. An improved lift cap for a jack according to claim 2 wherein said raised portion of said second portion extends beyond said first and second downwardly extending sides and the ends of said raised portion are beveled.

4. Am improved lift cap for a jack according to claim 2 wherein said downwardly extending U-shaped portion of second member has a top edge formed with an extending tab which is received in a slot formed in said top portion of said first member so as to eliminate a straight seam between said first and second members.

* * * * *